United States Patent [19]

Minks

[11] Patent Number: 4,507,633

[45] Date of Patent: Mar. 26, 1985

[54] SEALING MEANS FOR AN ELECTROMAGNETIC RELAY

[75] Inventor: Werner Minks, Heroldsberg, Fed. Rep. of Germany

[73] Assignee: International Standard Electric Corporation, New York, N.Y.

[21] Appl. No.: 587,109

[22] Filed: Mar. 7, 1984

[30] Foreign Application Priority Data

Mar. 12, 1983 [DE] Fed. Rep. of Germany ..... 3308821

[51] Int. Cl.[3] ..... H01H 13/04

[52] U.S. Cl. ..... 335/202; 335/278

[58] Field of Search ..... 335/202, 278, 128, 276

[56] References Cited

U.S. PATENT DOCUMENTS

| | | | |
|---|---|---|---|
| 3,544,930 | 12/1970 | Sauer | 335/202 |
| 4,185,163 | 1/1980 | Schedele | 335/202 |
| 4,355,291 | 10/1982 | Agatahama | 335/202 |

FOREIGN PATENT DOCUMENTS

| | | | |
|---|---|---|---|
| 2622133 | 12/1977 | Fed. Rep. of Germany | 335/202 |
| 271734 | 8/1978 | Fed. Rep. of Germany | 335/202 |
| 2851329 | 6/1979 | Fed. Rep. of Germany | 335/202 |
| 2934558 | 3/1980 | Fed. Rep. of Germany | 335/202 |
| 2840998 | 4/1980 | Fed. Rep. of Germany | 335/202 |
| 3131019 | 2/1983 | Fed. Rep. of Germany | 335/202 |
| 323034 | 3/1983 | Fed. Rep. of Germany | 335/202 |

*Primary Examiner*—George Harris

*Attorney, Agent, or Firm*—T. L. Peterson

[57] ABSTRACT

A leakproof electromagnetic relay in which a pourable sealing compound is introduced into the interior of the lower housing of the relay. A recess is formed in at least one sidewall of the housing through which the sealing compound is poured. The compound distributes itself equally on the bottom of the housing and flows into the separating points or gaps of the housing by capillary action. A cover closes the recess after the compound has been poured in. The invention permits the relay to be sealed in its upright position and further processed.

6 Claims, 3 Drawing Figures

SEALING MEANS FOR AN ELECTROMAGNETIC RELAY

BACKGROUND OF THE INVENTION

The present invention relates to a leakproof or waterproof electromagnetic relay.

Miniature relays are increasingly demanded in a leakproof design. This is achieved, for example, by having the rim portion of the cover projecting downwardly below the bottom of the lower housing providing an open cavity or space. The space is sealed with a casting resin while the relay is turned upside down. For an improved distribution of the sealing compound it is known, for example, from published German patent application DE-OS No. 28 51 329 and German petty patent No. 7821 508, to provide the under side of the bottom with a network of grooves extending to the separating points between the housing members and/or between the housing members and the contact terminals. By providing a predetermined amount of pourable sealing compound (casting resin) there is supposed to be obtained a sealed connection at all separating points of the housing parts into which the compound enters due to capillary action.

However, when pouring in the sealing compound from the bottom of the relay, the sealing compound may easily flow through an excessively large opening toward the inside of the housing, thus causing the relay to become unserviceable in certain cases. Moreover, the relay must remain in an inverted position until the sealing compound has hardened.

It is the object of the present invention to make a relay leakproof in a simple way without causing the aforementioned detrimental effects due to a wrong distribution of the sealing compound, thus permitting the relay to be easily further handled after the sealing process.

SUMMARY OF THE INVENTION

According to the invention there is provided an electromagnetic relay having a housing comprising a substantially cup-like lower housing member and a cup-like cover. The lower housing member contains the magnet system and the contact and connecting systems of the relay. The lower housing member has sidewalls and a bottom. The cover has its walls extending at least down to the bottom of the lower housing member. At least one recess is formed in at least one of the sidewalls above the bottom of the lower housing member for introducing a pourable sealing compound into the housing. The recess is covered by one of the walls of the cover.

By this arrangement the relay can be sealed in its normal upright position, with the terminals extending downwardly. In this way, the pourable sealing compound is prevented from flowing to the contact system within the relay housing. Moreover, during the sealing process, there may simultaneously be effected a fixing in position of the magnet system. Furthermore, the walls of the cover do not need to project downwardly below the bottom of the lower housing member thereby permitting a smaller overall height of the relay.

DESCRIPTION OF THE PREFERRED EMBODIMENT

Figure 1:
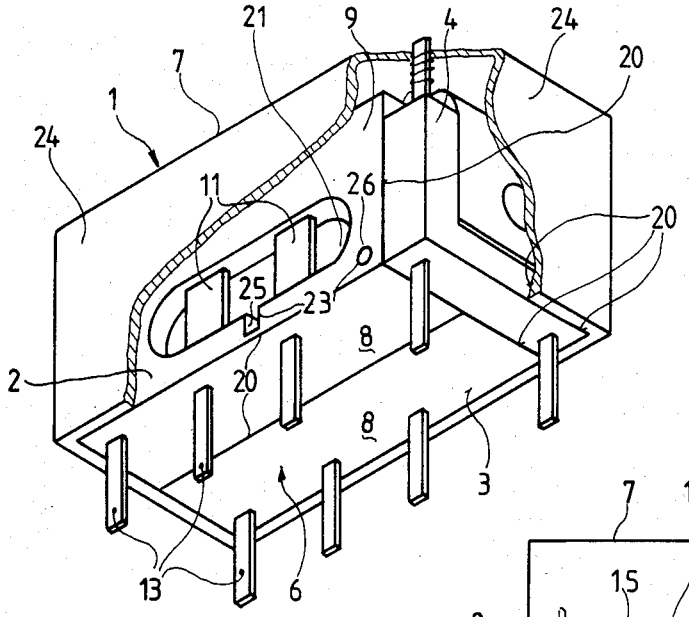
FIG. 1 is a perspective view of the relay according to the invention, as seen from below, with parts of the walls of the cover broken away to show the interior of the relay.
Figure 2:
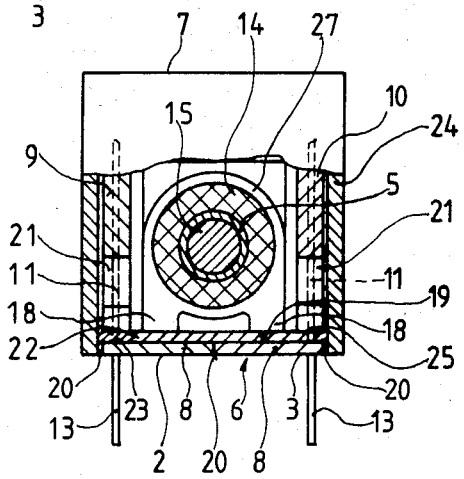
FIG. 2 is a partial transverse sectional view taken along lines A—A of FIG. 3.
Figure 3:
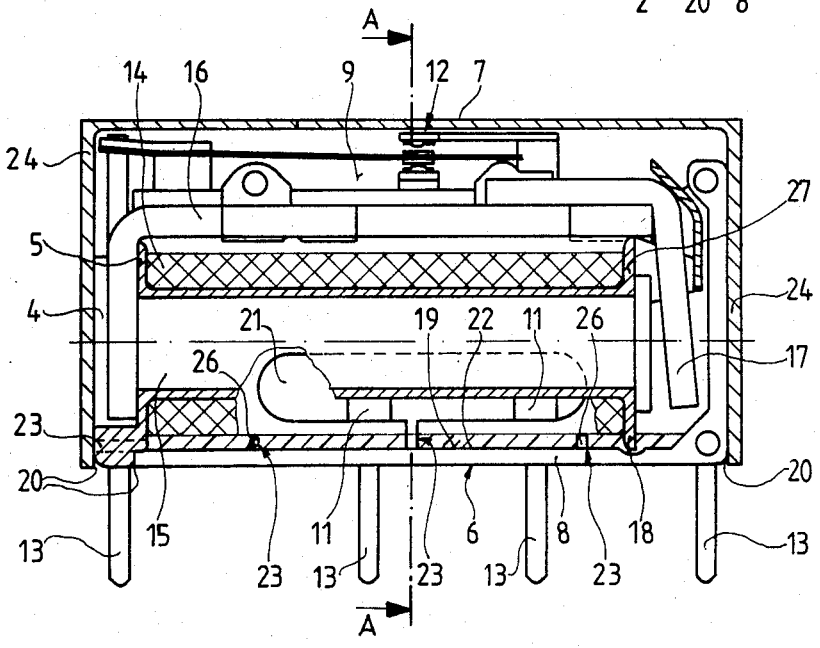
FIG. 3 is a partial longitudinal sectional view through the relay.

The miniature relay 1 of the invention comprises a substantially cup-like inner or lower housing member 6 comprising two housing shells 2 and 3, a flange 4 of a coilform 5, as well as a cup-like cover 7. The cover extends over the lower housing member 6 down to about the bottom 8. The two housing shells 2 and 3 have an L-shaped cross section (see FIG. 2).

The housing shells 2 and 3 form sidewalls 9 and 10 of the lower housing member 6. The shells 2 and 3 are made from a plastic material. The metal parts 11 of the contact systems 12 and the terminals 13 are embedded in the sidewalls 9 and 10 in a conventional manner.

The lower housing member 6 may also be formed of one plastic part, or else it may be composed of several parts, for example, of two sidewalls 9 and 10 and a center U-shaped part, not shown.

The individual housing shells 2 and 3 may be held together by the cover 7 or may be previously connected by bonding, ultrasonic welding, etc.

The magnet system of the relay is mounted in the lower housing member 6. The magnet system comprises the coilform 5, a winding 14, a magnet core 15, a magnetic yoke 16 firmly connected thereto magnetically and mechanically, and a tilting armature 17. Supporting members or legs 18 are molded to the coilform 5. The supporting members stand on the upper surface 19 of the bottom part 8.

To obtain a leakproof relay 1, the separating points or expansion joints (gaps) 20 between the individual components of the relay housing must be tightly sealed. According to the invention, this is effected from the inside by providing at least one recess 21 in each of the sidewalls 9 and 10 of the lower housing member 6. A pourable sealing compount 22 is introduced into the interior of the lower housing member through the recesses. The compound distributes itself over the bottom 8 of the lower housing member 6. Due to capillary action, the compound flows into the separating points (gaps) 20 between the two housing shells 2 and 3. The cover 7 is then mounted over the lower housing member 6 with its walls 24 covering the recesses 21.

In at least one sidewall 9 and 10 and/or the coilform flange 4 there is provided at least one opening 23 extending down to the upper surface 19 of the bottom part 8, through which the pourable sealing compound 22 can flow from the inside to the outside. Thus, after introducing the pourable sealing compound 22 through the recess 21, and by subsequently positioning the cover 7 over the lower housing member, the pourable sealing compound will flow by capillary action through the openings 23 into the separating points (gaps) 20 between the walls 24 of the cover 7 and the lower housing member. Due to the capillary action at the very small separating points 20, the pourable sealing compound 22 is prevented from flowing or dripping out through the bottom of the assembly.

The openings 23 may be in the form of slots in the sidewalls 9 and 10 extending from the lower edge of the recesses 21 down to the upper surface 19 of the bottom part 8. Alternatively, the openings may be formed by small boreholes 26 which are arranged above the bottom part 8, but extend down to the surface 19. The openings 23 may be distributed in such a way along the circumference as to ensure a uniform flow of the sealing compound toward all separating points 20 within a predetermined time period.

The pourable sealing compound 22 is preferably a compound which has a lower viscosity at an increased temperature. Thus, following the introduction of the sealing compound and the placement of the cover 7, it is possible to effect a quicker and more uniform distribution of the sealing compound by heating the assembly. Heating will permit a good flow of the compound into the separating points 20 between the components of the assembly.

Introducing the sealing compound into the interior of the housing can be advantageously utilized to secure internal parts, such as the coil flange 27 to the bottom member 8. For example, supporting members 18 on the bottom of the flange 27, which rest on the surface 19 are embedded in the pourable sealing compound (casting resin) 22. This assures that the magnet system will be firmly held in position so that the relay will be resistant to shocks and vibration.

What is claimed is:

1. In an electromagnetic relay having a housing comprising a substantially cup-like lower housing member and a cup-like cover, said lower housing member containing the magnet system, the contact and connecting systems, and the terminals of the relay, said lower housing member having sidewalls and a bottom, and terminals extending downwardly from said bottom, said lower housing member having walls extending at least down to the bottom of the lower housing member, the improvement comprising:

at least one recess in at least one of said sidewalls, said recess extending through said sidewall above said bottom for introducing a pourable sealing compound into said lower housing member, said recess being covered by one of said walls of said cover; and at least one sidewall of said lower housing member having at least one opening extending down to said bottom for permitting sealing compound to flow from the interior of said lower housing member outwardly through said opening to the gap between said walls of said cover and said sidewalls to provide a seal therebetween.

2. A relay as set forth in claim 1 wherein:

said lower housing member comprises two parts of L-shaped cross-section.

3. A relay as set forth in claim 2 wherein:

said parts are held together by said cover.

4. A relay as set forth in claim 1, wherein:

said opening communicates with said recess.

5. A relay as set forth in claim 4 wherein:

said opening extends from the lower edge of said recess to the upper surface of said bottom.

6. A relay as set forth in claim 1 wherein:

said magnet system includes a coilform having end flanges, the lower parts of said flanges being embedded in a layer of sealed compound on the upper surface of said bottom of said lower housing member.

* * * * *